US008393016B2

(12) United States Patent
Wilkins-Gaudio

(10) Patent No.: US 8,393,016 B2
(45) Date of Patent: Mar. 12, 2013

(54) DISCREET ELASTIC BELT

(75) Inventor: Leslie Wilkins-Gaudio, Armonk, NY (US)

(73) Assignee: Isabelt Ltd., Thornwood, NY (US)

( * ) Notice: Subject to any disclaimer, the term of this patent is extended or adjusted under 35 U.S.C. 154(b) by 759 days.

(21) Appl. No.: 12/072,132

(22) Filed: Feb. 22, 2008

(65) Prior Publication Data

US 2008/0289084 A1 Nov. 27, 2008

Related U.S. Application Data

(60) Provisional application No. 60/902,627, filed on Feb. 22, 2007.

(51) Int. Cl.
*A41F 9/02* (2006.01)

(52) U.S. Cl. ..... 2/312; 2/338

(58) Field of Classification Search ..... 2/337, 338, 2/339, 340, 341, 342, 311, 312, 316, 317, 2/318, 319, 320, 321, 322, 335, 336, 452, 2/155, 156, 157, 160, 300, 301, 303, 304, 2/305, 306, 307, 308, 309, 310, 313, 314, 2/315, 323, 325, 327, 329, 330, 331, 332, 2/333; 450/63, 64, 85, 86, 87, 88, 111, 113, 450/119, 28, 29

See application file for complete search history.

(56) References Cited

U.S. PATENT DOCUMENTS

| | | | | | |
|---|---|---|---|---|---|
| 725,437 | A | * | 4/1903 | Gluckauf | 2/301 |
| 746,677 | A | * | 12/1903 | Cohn | 2/315 |
| 751,132 | A | * | 2/1904 | Zenger | 2/312 |
| 886,780 | A | * | 5/1908 | Dwyer | 2/311 |
| 1,065,297 | A | * | 6/1913 | Crawford | 2/311 |
| 1,085,019 | A | * | 1/1914 | Cohn | 2/317 |
| 1,187,680 | A | * | 6/1916 | Torem et al. | 2/321 |
| 1,224,154 | A | * | 5/1917 | Esser | 2/313 |
| 1,233,834 | A | * | 7/1917 | Baumann | 2/301 |
| 1,328,931 | A | * | 1/1920 | Stevens | 2/301 |
| 1,331,457 | A | * | 2/1920 | Elliott | 2/221 |
| 1,401,227 | A | * | 12/1921 | Wyeth | 2/323 |
| 1,448,399 | A | * | 3/1923 | Graf | 2/317 |
| 1,513,764 | A | * | 11/1924 | Sanders | 2/315 |
| 1,514,726 | A | * | 11/1924 | Prentice | 2/317 |
| 1,549,672 | A | * | 8/1925 | Lazier | 2/323 |
| 1,600,278 | A | * | 9/1926 | Epstein | 2/339 |
| 1,625,166 | A | * | 4/1927 | Siegel | 2/309 |
| 1,648,776 | A | * | 11/1927 | McOrin | 2/323 |
| 1,782,057 | A | * | 11/1930 | Bollinger | 24/301 |
| 1,908,038 | A | * | 5/1933 | Mackenzie | 2/321 |
| 2,002,946 | A | * | 5/1935 | Jacobs | 24/197 |
| 2,417,332 | A | * | 3/1947 | Veitch | 2/316 |
| 2,513,886 | A | | 7/1950 | Mix | |
| 2,568,670 | A | * | 9/1951 | Traub et al. | 2/325 |
| 2,596,884 | A | | 5/1952 | Bailen | |
| 2,736,899 | A | * | 3/1956 | Ayres | 450/82 |
| 2,849,723 | A | * | 9/1958 | Marino | 2/323 |

(Continued)

OTHER PUBLICATIONS

International Search Report and Written Opinion, dated Jun. 25, 2008.

*Primary Examiner* — Alissa L Hoey

(74) *Attorney, Agent, or Firm* — Sorell, Lenna & Schmidt, LLP

(57) ABSTRACT

The invention relates to clothing support devices, and more particularly, discreet belts that support clothing, such as trousers, skirts, or the like, around a waist of a user. Provided is a discreet belt that includes a belt body formed from a flexible, elongated elastic strap adapted to be used in at least one fastening element and at least one adjusting element. Various embodiments, variants and method aspect are also provided.

20 Claims, 3 Drawing Sheets

U.S. PATENT DOCUMENTS 2,895,480 A * 7/1959 Fixel ..... 450/29
2,896,220 A 7/1959 Kenny
2,911,653 A * 11/1959 O'Donnell ..... 2/321
3,153,333 A * 10/1964 Chisholm ..... 63/5.1
3,179,109 A * 4/1965 Born ..... 450/83
3,276,088 A * 10/1966 Block et al. ..... 24/265 A
3,290,696 A * 12/1966 Rosenzweig ..... 2/323
3,355,744 A * 12/1967 Wilson ..... 2/338
3,841,542 A * 10/1974 Hogensen, Jr. ..... 224/586
3,848,270 A * 11/1974 Rand ..... 2/311
3,920,166 A * 11/1975 Hogensen, Jr. ..... 224/586
4,894,868 A * 1/1990 Christopher ..... 2/268
4,985,937 A * 1/1991 Blackburn ..... 2/312
5,023,956 A 6/1991 Fox
5,046,197 A 9/1991 Chernuchin et al.
5,063,615 A 11/1991 Chernuchin et al.
5,149,293 A * 9/1992 Gable ..... 450/86
5,245,707 A * 9/1993 Green ..... 2/54
5,313,669 A * 5/1994 Rasdell et al. ..... 2/323
5,797,145 A 8/1998 Levinson
5,797,171 A 8/1998 Nelson
5,806,087 A * 9/1998 Grotefend ..... 2/1
5,873,133 A * 2/1999 Jurga et al. ..... 2/322
5,908,206 A * 6/1999 LoPresti, Jr. ..... 280/814
5,915,535 A * 6/1999 Henrekin-Jordan ..... 2/195.2
5,970,526 A * 10/1999 Weathers ..... 2/321
6,006,364 A * 12/1999 Newsom et al. ..... 2/323
6,056,625 A * 5/2000 Fildan ..... 450/86
6,056,626 A * 5/2000 Fildan ..... 450/86
6,059,634 A * 5/2000 Fildan ..... 450/86
6,155,906 A * 12/2000 May ..... 450/88
6,179,687 B1 * 1/2001 Lee et al. ..... 450/88
6,206,752 B1 3/2001 Fagin et al.
6,368,180 B1 * 4/2002 Dailey ..... 450/86
6,389,605 B2 * 5/2002 Srivastava ..... 2/312
6,547,636 B1 * 4/2003 Cato ..... 450/88
6,656,013 B1 * 12/2003 Wang ..... 450/86
6,687,916 B2 * 2/2004 Thompson ..... 2/170
6,755,799 B2 * 6/2004 Toda ..... 602/19
6,954,949 B1 10/2005 Chen
7,232,359 B1 6/2007 Richardson
D661,461 S * 6/2012 Murray ..... D2/627
2002/0157172 A1 10/2002 Matsushima et al.
2003/0232572 A1 * 12/2003 Wang ..... 450/86
2005/0039244 A1 2/2005 Goldfarb et al.
2005/0150034 A1 * 7/2005 Marks ..... 2/338
2006/0117465 A1 * 6/2006 Willows et al. ..... 2/338
2006/0218690 A1 10/2006 James
2006/0230504 A1 10/2006 Razzaghi et al.
2008/0190980 A1 * 8/2008 Overton ..... 224/664
2009/0007316 A1 * 1/2009 Escudero Munoz ..... 2/300
2010/0235967 A1 * 9/2010 Janakus et al. ..... 2/311

* cited by examiner

DISCREET ELASTIC BELT

CROSS-REFERENCE TO RELATED APPLICATIONS

This application claims the benefit of U.S. Provisional Patent Application No. 60/902,627, filed Feb. 22, 2007, the entirety of which is incorporated herein by reference.

TECHNICAL FIELD

The present invention is directed to clothing support devices, and more particularly, belts that are discreet and may be used to stretchably support a clothing article while being worn around a waist of a user.

BACKGROUND

Traditional or conventional belts, usually constructed with a buckle mechanism and other hardware, can provide garment support. However, for certain applications, aesthetic, fashion, and fit issues may arise that highlight the limitations of conventional belts for such applications. For example, in many situations, conventional belts have too much, or too little, material left after adjustments, and users are left with the fit and fashion problems.

Many times, users have to balance the fit of a belt with the fashion look the user desires. Conventional belt buckles, hardware, holes, excessive material, or the like create and/or contribute to fit and fashion problems. When trying to figure out how to deal with fit problems of conventional belts, users may have to pull conventional belts too tight thereby ruining the fashion look the users desire to achieve. Typically, users want to prevent clothing problems, such as, trousers that gap in the back, pants that fall down exposing undergarments, pants that slip down repeatedly, and the like. Even though users may consider comfortable fit and outfit support when deciding to employ conventional belts, many users do not want to employ conventional belts that would ruin the desired fashion look of the outfit. Typically, users want to maintain outfit support, comfortable fit, and fashion look.

In other situations, body shape or figure of users can create issues with certain articles of clothing. For instance, people with large physical posteriors and small waists can have a difficult time finding clothing to fit their body shapes. As a result, people in such a situation have to buy larger sizes to accommodate their body shape even though the waistline of the garment is larger than necessary for the waist of those potential belt users. In other situations, physical medical issues, such as scoliosis or the like, prevent garments from fitting without additional support. Traditional or conventional belts do not provide enough support in these situations, particularly where conventional belts can not be adjusted properly to allow a user to wear clothing with comfort.

The inventors have recognized that when dealing with the fashion problems of conventional belts, belt users have to deal with bulges underneath clothing. There are many times when a user requires the support of a belt but does not want to wear a traditional or conventional belt with hardware, buckles, holes, excessive material, or the like since such components of a belt interfere with the user's outfit fashion look. Typically, when a user puts on a traditional or conventional belt, the user has to feed the end of a strap through a buckle which can leave extra material at the end of the belt which adds more bulk to a person's outfit. When wearing an outfit where a shirt will go over the waist of the bottom garment, a conventional belt, with a buckle or other hardware, may bulge under the shirt. For those users who consider fit and fashion of an outfit of clothing when deciding on belt choice, bulge or too much thickness can ruin the fit and/or the fashion look the user is trying to achieve.

Another problem with conventional belts occurs when such belts lack fashion design, such as colors, patterns, graphic designs, different widths, or the like. When considering a belt to use with an outfit, a user may find that conventional belts are inadequate to supplement a fashion look for garments.

The inventors recognized that there is a need for a discreet, in certain situations, barely visible to virtually invisible, adjustable belt for supporting clothing around a waist of a user which can be customized and/or adjusted as the user desires.

In one aspect, there is provided a discreet belt for a clothing article, the belt including:

a belt body formed from a flexible, elongated, elastic strap;

at least one fastening element operably connected to the belt body, wherein the at least one fastening element is adapted to releasably close the belt around an outer surface of the clothing article; and at least one adjusting element operably connected to the belt body, wherein the adjusting element is adapted to increase and/or decrease a length of the belt body so that the belt may be tightened and/or loosened around an outer surface of the clothing article to secure the clothing article to a waist of a user. Various embodiments and variants are provided.

In an embodiment, there is provided a discreet belt for a clothing article, the belt including:

a belt body having a first terminal end and a second terminal end, the belt body being formed by a flexible, elongated, thermoplastic strap, the strap being transparent, semi-transparent or opaque;

a first clasp operably attached to the first terminal end of the belt body and a second clasp operably attached to the second terminal end of the belt body, the clasps adapted to be releasably fastened to one another to close the belt around an outer surface of the clothing apparel; and two cinch buckles operably connected to the belt body, wherein the cinch buckles are adapted to increase and/or decrease a length of the belt body so that the belt may be tightened and/or loosened around an outer surface of the clothing article to secure the clothing article to a waist of a user. Various embodiments and variants are provided.

In another aspect, there is provided a method of improving a fit between a clothing article and a waist of a wearer, the method including providing the wearer with a discreet belt that includes:

a belt body formed from a flexible, elongated, plastic strap;

at least one fastening element operably connected to the belt body, wherein the at least one fastening element is adapted to releasably close the belt around the outer surface of the clothing article; and at least one adjusting element operably connected to the belt body, wherein the adjusting element is adapted to increase and/or decrease the length of the belt body so that said belt may be tightened and/or loosened around the outer surface of the clothing article to secure the clothing article to the waist of the wearer; whereby enabling the wearer to control the fit between the clothing article and the wearer's waist by tightening and/or loosening said belt. Various embodiments and variants are provided.

Other features will become clearer from the detailed description in conjunction with the accompanying drawings.

BRIEF DESCRIPTION OF THE DRAWINGS

For the purposes of illustrating the various aspects of the invention, wherein like numerals indicate like elements, there are shown in the drawings simplified forms that may be employed, it being understood, however, that the invention is not limited by or to the precise arrangements and instrumentalities shown, but rather only by the claims. The drawings may not be to scale, and the aspects of the drawings may not be to scale relative to each other. To assist those of ordinary skill in the relevant art in making and using the subject matter hereof, reference is made to the appended drawings and figures, wherein:

DETAILED DESCRIPTION

The terms used in the claims are hereby defined as follows.

The term "belt body" denotes all components of the discreet belt described herein except fastening and adjusting elements. The belt body is formed from a flexible, elongated, plastic strap, but may include additional structural and/or design elements. The term "elastic" with respect to the "strap" described herein denotes a unit that upon being stretched creates a tension force in the direction opposite to the direction of stretching. When the discreet belt is closed, this tension force may be directed toward the waist of the wearer, pulling the clothing article closer in. The term "secure" may or may not denote keeping the clothing article on, but does denote the existence of the tension force.

The term "fastening element" denotes a structural unit that is adopted to fasten one portion of the belt body to another.

The term "adjusting element" denotes a structural unit that is adopted to adjust the length of the belt body.

Discreet belts are disclosed herein for securing an article of clothing apparel around a waist of a user. The belts may be employed to secure garments, such as, but not limited to, trousers, skirts, dresses, shorts, or the like.

In particular, while the invention is not limited by any specific theory, one area of application for discreet belts disclosed herein is worth specific mention. The inventors have recognized that clothing wearers often desire to improve the fit between a clothing article and the waist. Whether or not such improvement relates to improved support, clothing wearers may wish to bring the clothing article closer to the waist, for example, to minimize exposure of the undergarments. This may be particularly true with jeans, which often have bulging excess of material around the waist, especially apparent when the wearer is seated. The inventors also recognized that fashion belts are not usually suitable to address this issue, as their design often more concerned with appearance rather than functionality.

Figure 1:
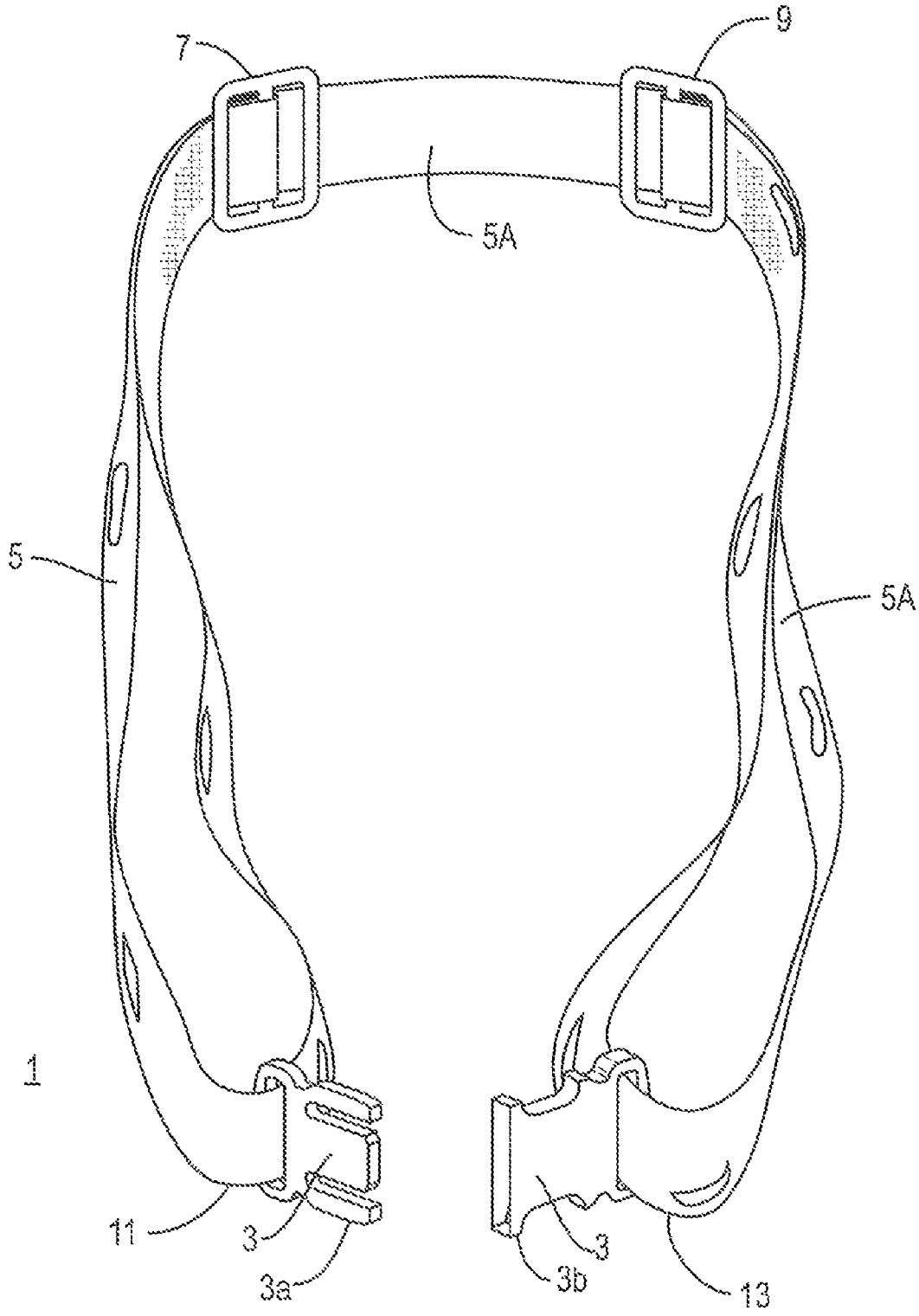
FIG. 1 is a partially perspective view of the discreet belt in accordance with at least one aspect of the present invention.

FIG. 1 is a partially perspective view of an embodiment of a discreet belt 1 in accordance with at least one aspect of the present invention. The discreet belt 1 includes at least one fastening element 3, a belt body 5 formed from a strap 5A, and at least one adjusting element 7.

Those skilled in the art will recognize that any type of clear, translucent, transparent, semi-transparent, or opaque material may be used to make the strap 5A, which is a flexible, elongated, plastic unit from which the belt body 5 is formed.

Preferably, the strap 5A is made of thermoplastic polymer, for example, polyurethane, and is stretchable and elastic, thus permitting the belt 1 to have tension when it is wore. The material used for strap 5A may be as soft as needed to give the belt 1 the desired flexibility, stretch, and/or elasticity and as hard as needed to maintaining support and tension for the clothing. To improve the invisible look of belt 1, the belt body 5 lies flat against a waist of a user. In some embodiments, the width of strap 5A may vary over the length for fit and fashion of a user. In a preferred embodiment, belt 1 is made from thermoplastic polyurethane polymer to provide a secure fit that clings well to garments. In other embodiments, belt 1 may comprise other materials to offer more variety and decorative options while maintaining the same support as with clear thermoplastic polyurethane polymer material. In accordance with at least one embodiment, the belt 1 may be made in different lengths and widths.

Figure 3:
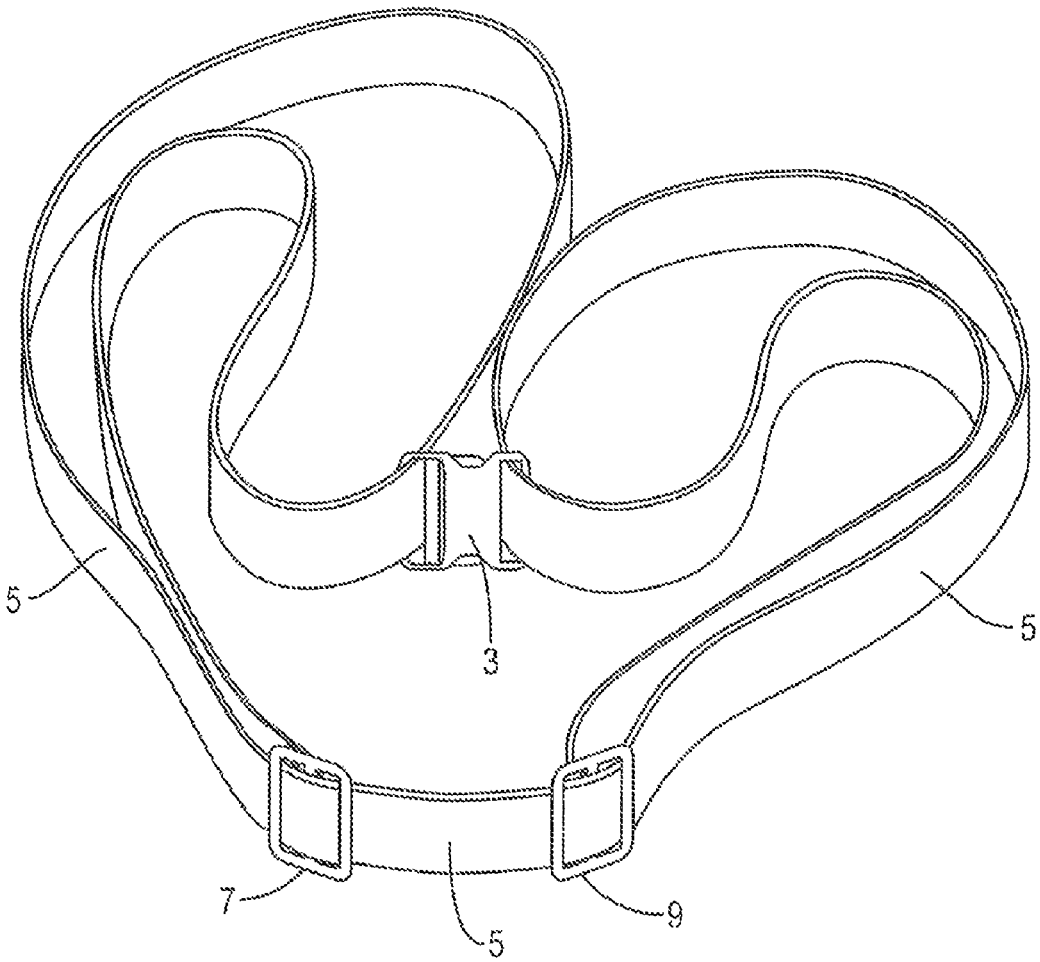
FIG. 3 is a partially perspective view of a closed discreet belt in accordance with at least one aspect of the present invention.

As set forth above, the belt 1 includes at least one fastening element 3. Any fastening element suitable for releasably closing the belt 1 around a waist of a user may be included. With reference to FIG. 1, the belt 1 may include two fastening elements 3*a*, 3*b*, which are operably connected to terminal ends 11, 13 of belt body 5, respectively. The user of the discreet belt 1 releasably connects fastening element 3*a* to fastening element 3*b* to close the belt 5, e.g., as shown in FIG. 3.

In accordance with at least one embodiment, fastening element(s) 3 of the belt 1 preferably lies flat against the waist of a user. This eliminates the need for traditional or conventional belt buckles, which are bulky and may negatively impact the fit and/or fashion of clothing apparel. However, a user may wear traditional or conventional belts and/or buckles over the discreet belt 1 to supplement the fashion look of the outfit if desired. Those skilled in the art will recognize that any type of fastening element 3 may be used to secure belt 1 to a user, such as, but not limited to, a clasp, a closure buckle, a clip, a fastener, or the like. Fastening element 3 may be worn underneath clothing loops or may be worn in front of or around a waist of a user. Those skilled in the art will further recognize that fastening element 3 may comprise any type of material to give the belt the appearance of invisibility, such as, but not limited to, clear plastic, suitable polymer, which may be injection molded, polyurethane polymer, thermoplastic polyurethane polymer, or the like. Fastening element 3 may comprise other textile materials to offer more variety and decorative options while maintaining the same support as with clear thermoplastic polyurethane polymer material.

In accordance with a broad aspect of the present invention, at least one adjusting element 7 is operably connected to a belt body 5. The adjustability provides an accurate and custom fit for the user. In accordance with at least one preferred embodiment, two symmetrically designed adjustment elements 7, 9 are provided at substantially equal distances from fastening elements 3*a*, 3*b*, respectively. Adjusting elements 7, 9 are adapted to increase and/or decrease the length of belt body 5A around a waist of a user so a user may adjust the fit and fashion look of discreet belt 1. The adjusting elements 7, 9 allow the user to personalize the fit in accordance with the support needed or desired. In accordance with at least one embodiment, adjusting elements 7, 9 lie flat against the waist of a user. Any type of adjusting element 7, 9 may be used to adjust the belt 1 around a waist of a user, such as, but not limited to, a cinch buckle, an adjustor, or the like. The adjusting elements 7, 9 may comprise any type of material to give the belt the appearance of invisibility, such as, but not limited to, clear plastic, suitable polymer, which may be injection molded, polyurethane polymer, thermoplastic polyurethane polymer, or the like. Adjusting elements 7, 9 may comprise other textile materials to offer more variety and decorative options while maintaining the same support as with clear thermoplastic polyurethane polymer material.

Respective terminal ends 11, 13 of the belt body 5 may originate at, and are coupled to, the fastening element 3. In accordance with at least one preferred embodiment, respective ends of strap 5 may loop (loops shown in FIG. 3) through at least one fastening element 3*a*, 3*b* and connect to at least one respective adjusting element 7, 9. When a user adjusts a belt 1 with adjusting elements 7, 9, the length of the belt 1 changes accordingly. As the length of the belt 1 changes, fastening elements 3*a*, 3*b* of fastening element 3 shifts along strap 5. Once fastening elements 3*a*, 3*b* relocate along strap 5, the new locations on respective ends of strap 5 are respective terminal ends 11, 13. Where one adjusting element 7 (or 9) is used on a discreet belt 1, terminal end 13 (or 11) of strap 5 can remain the same while the position of terminal end 11 (or 13) shifts when a user adjusts the length of strap 5. Those skilled in the art will recognize how to adjust adjusting elements 7, 9. In at least one embodiment, a user adjusts the length of a belt 1 by holding the belt 1 close to an adjusting element 7 with a thumb and forefinger of a first hand. With a second hand, the user gently pulls the strap 5 through the adjusting element 7 at a downward angle to lengthen or shorten the belt. A user may then repeat the adjustment on any other adjusting element 9 until the desired customizable support is reached.

Once a user adjusts the belt 1 as desired, a user puts the belt 1 through clothing loops and clasps the belt together. A user may push the belt down to a base of a waistband if desired for support. Those skilled in the art will recognize how to put a belt 1 through waist loops of clothing, such as, but not limited to, pant loops, trouser loops, shorts loops, dress loops, skirt loops, or the like. In other embodiments, a user may wear a belt 1 for clothing without loops.

Figure 2:
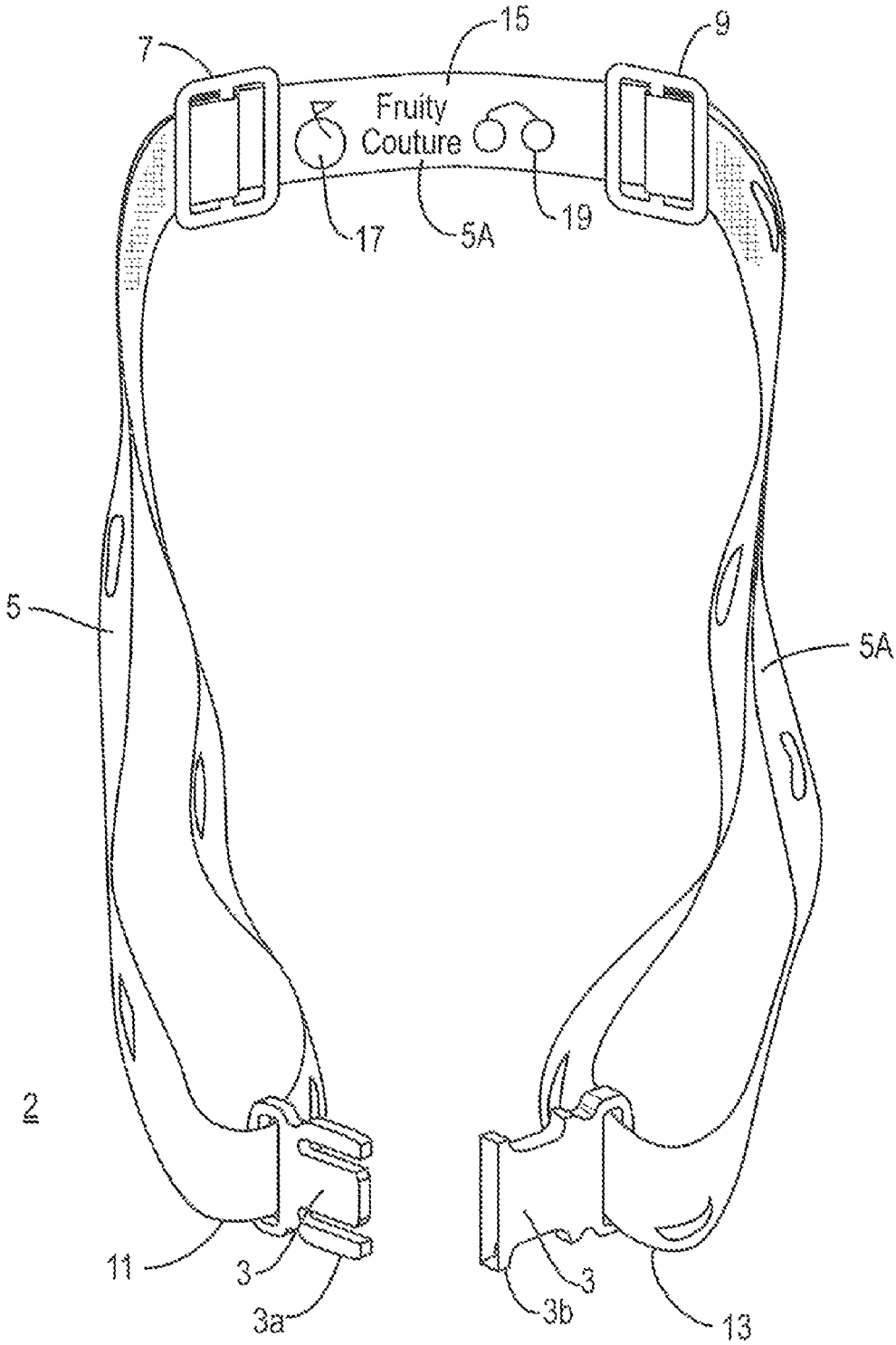
FIG. 2 is a partially perspective view of the discreet belt with graphical designs in accordance with at least one embodiment of the present invention.

Reference is now made to FIG. 2, which is a partially perspective view of a discreet belt 2 with text 15 and graphical designs 17, 19. Those skilled in the art will recognize that users can supplement a fashion look of an outfit with attached belt designs, such as, but not limited to, different textures, text, designs, graphical designs, colors, patterns, different widths, attached embellishments, finishes, appliques, or the like. Belt 2 may be manufactured with attached text 15 or graphical designs 17, 19 for a more fashionable statement. Text 15 and designs 17, 19 may be added to belt 2 after initial manufacture of the belt as well.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A discreet belt for a clothing article, said belt consisting of:

a belt body formed from a flexible, single elongated, elastic strap, the belt body having a first end, a second end, a first terminal end and a second terminal end;

a fastening element having a first fastener terminal end and a second fastener terminal end, wherein the first fastener terminal end comprises a male portion and the second fastener terminal end comprises a corresponding female portion, wherein the fastening element is slidably connected to the belt body and the first and second terminal ends releasably engage and interlock with each other to fix the first end to the second end to form a closed belt around an outer surface of the clothing article, wherein when the belt is closed, the belt is configured to apply a tension force directed towards a waist of the user pulling the clothing article closer in to the user's waist; and at least one adjusting element fixedly attached to the first and/or second end and operably connected to said belt body, wherein said at least one adjusting element is configured for movement between the first end and the second end of the belt body such that the belt can be tightened and/or loosened around an outer surface of the clothing article to secure the clothing article to the waist of a user;

wherein the belt body is configured to form three discrete sections from said single elongated, elastic strap, the discrete sections comprising:

a first discrete section is an enclosed loop formed by the operable connection of the at least one adjusting element disposed at the first terminal end;

a second discrete section is an enclosed loop formed by the operable connection of the another of at least one adjusting element disposed at the second terminal end, and a third discrete section formed as a linear section of said single elongated, elastic strap, the third section coupling the first and second sections.

2. The discrete belt of claim 1, wherein said strap is semi-transparent.

3. The discrete belt of claim 1, wherein said first terminal end being operably attached to said second terminal end by said at least one fastening element when said belt is closed.

4. The discrete belt of claim 1, wherein said strap is stretchable.

5. The discrete belt of claim 1, wherein said strap is made of plastic.

6. The discreet belt of claim 5, wherein said strap is made from a thermoplastic polymer.

7. The discreet belt of claim 6, wherein said thermoplastic polymer is polyurethane.

8. The discrete belt of claim 1, wherein said at least one fastening element is made of a hard plastic.

9. The discrete belt of claim 1, wherein said at least one adjusting element is made of a hard plastic.

10. The discrete belt of claim 1, wherein said belt body, said at least one fastening element, and/or said at least one adjusting element further comprises at least one of: colors, patterns, designs, attachments, text, textures, finishes, graphical designs, attached embellishments, and appliques.

11. The discrete belt of claim 1, which is adopted specifically for a clothing article being jeans.

12. The discrete belt of claim 1, wherein said strap, said adjusting element, and/or said fastening element is substantially flat.

13. The discrete belt of claim 1, which includes two adjusting elements.

14. The discreet belt of claim 13, wherein said two adjusting elements are located at substantially equal distances from said fastening elements.

15. The discreet belt of claim 13, wherein the two adjusting elements are positionable between a first orientation and a second orientation.

16. The discreet belt of claim 15, wherein the first orientation is such that the two adjusting elements are adjacent to each other and the second orientation is such that the two adjusting elements are separated from each other.

17. A discreet belt for a clothing article, said belt consisting of:

a belt body having a first end, a second end, a first terminal end and a second terminal end, said belt body being formed by a flexible, elastic continuous elongated strap;

a first clasp having a male portion and being slidably attached to said first end of said belt body and a second clasp having a corresponding female portion and being slidably attached to said second end of said belt body, said clasps releasably engage with and interlock with each other to fasten the first end to the second end to form a closed belt around an outer surface of said clothing apparel, wherein when the belt is closed, the belt is configured to apply a tension force directed towards a waist of the user pulling the clothing article closer in to the user's waist; and a first and second cinch buckle fixedly attached to the first and second ends, respectively wherein said first and second cinch buckles are each configured for movement between the first end and the second end of the belt body such that the belt can be tightened and/or loosened around an outer surface of the clothing article to secure the clothing article to a waits of a user, wherein said first and second cinch buckles are positionable between a first orientation such that the first and second cinch buckles are adjacent each other to a second orientation such that the first and second cinch buckles are space apart from each other, wherein the belt body is configured to form three discrete sections from the flexible, elastic continuous elongated strap, the discrete sections comprising:

a first section comprising a first separately adjustable loop formed by the operable connection of the first cinch buckle to the belt body disposed at the first terminal end, a second section comprising a second separately adjustable loop formed by the operable connection of the second cinch buckle to the belt body disposed at the second terminal end, and a non-looped third section formed as a linear section of the flexible, elastic continuous elongated, strap, the third section coupling being disposed between the first and second cinch buckles.

18. The discrete belt of claim 17, wherein said strap is stretchable.

19. The discrete belt of claim 17, wherein said strap is made from polyurethane polymer.

20. The discrete belt of claim 17, wherein said clasps are made from hard, opaque plastic.

* * * * *